US006106985A

United States Patent [19]

Yamasaki et al.

[11] Patent Number: 6,106,985

[45] Date of Patent: Aug. 22, 2000

[54] LAYERED-FORM ELECTROPHOTOGRAPHIC PHOTORECEPTOR

[75] Inventors: Yasuhiro Yamasaki; Kazuyoshi Kuroda, both of Neyagawa, Japan

[73] Assignee: Orient Chemical Industries, Ltd., Osaka-fu, Japan

[21] Appl. No.: 09/260,732

[22] Filed: Mar. 3, 1999

[30] Foreign Application Priority Data

Mar. 10, 1998 [JP] Japan ..... 10-057994

[51] Int. Cl.[7] ..... G03G 15/02

[52] U.S. Cl. ..... 430/58.15; 430/59.4

[58] Field of Search ..... 430/58.15, 58.4, 430/59.4

[56] References Cited

U.S. PATENT DOCUMENTS

| | | | |
|---|---|---|---|
| 4,423,130 | 12/1983 | Horie et al. . | |
| 4,619,880 | 10/1986 | Horie et al. . | |
| 4,622,278 | 11/1986 | Kondo et al. . | |
| 4,814,245 | 3/1989 | Horie et al. . | |
| 4,973,536 | 11/1990 | Horie et al. . | |
| 5,456,998 | 10/1995 | Burt et al. | 430/59.4 |
| 5,725,984 | 3/1998 | Yamasaki et al. . | |

FOREIGN PATENT DOCUMENTS

| | | |
|---|---|---|
| 241021 | 9/1982 | Japan . |
| 60-163047 | 8/1985 | Japan . |
| 60-196767 | 10/1985 | Japan . |
| 60-262162 | 12/1985 | Japan . |
| 63-48551 | 3/1988 | Japan . |
| 63-48552 | 3/1988 | Japan . |
| 44260 | 1/1992 | Japan . |
| 4233548 | 8/1992 | Japan . |
| 9217020 | 8/1997 | Japan . |

*Primary Examiner*—Christopher D. Rodee
*Attorney, Agent, or Firm*—Birch, Stewart, Kolasch & Birch, LLP

[57] ABSTRACT

A layered-form electrophotographic photoreceptor which is composed of a conductive substrate, a charge generating layer (CGL) laid on the conductive substrate, and a charge transporting layer (CTL) laid on the CGL, wherein the CGL includes $\mu$-oxo-aluminum phthalocyanine dimer as a charge generating material (CGM), and the CTL comprises a specific hydrazone compound as a charge transporting material (CTM). The electrophotographic photoreceptor shows good stability and electric property (for example, good chargeability, low dark decay, and low residual potential), even if it is employed as a high-gamma photoreceptor which corresponds to a short wavelength light sauce such as LD ray and LED ray.

6 Claims, 5 Drawing Sheets

LAYERED-FORM ELECTROPHOTOGRAPHIC PHOTORECEPTOR

FIELD OF THE INVENTION

The present invention relates to a layered-form electrophotographic photoreceptor which is composed of a conductive substrate, and a photoreceptor layer applied thereon, the photoreceptor layer being composed of a charge generating layer and a charge transporting layer. More specifically, the present invention relates to an organic photoreceptor of which the charge generating layer comprises $\mu$-oxo-aluminum phthalocyanine dimer having a novel polymorph, and the charge transporting layer comprises a specific hydrazone charge transporting material. The present invention also relates to a durable and high-sensitive layered-form photoreceptor suitable for a short wavelength light source such as 633 nm LD ray and LED ray.

BACKGROUND OF THE INVENTION

An electrophotographic photoreceptor is the component which provides an imagewise latent image consisting of electric charge on the surface thereof when it is irradiated along an image to be developed. An electrophotographic photoreceptor therefore has a charge generating layer (CGL) which generates charge by irradiation on a conductive substrate.

An electrophotographic photoreceptor have been widely applied to an electrophotographic apparatus such as a copying machine, a printer, and the like. In recent years, semiconductor laser ray, which is a compact and low-cost light source, is mainly employed as a light source for an electrophotographic photoreceptor of such an electrophotographic apparatus. Thus, an organic photoconductive substance (OPC) which is sensitive to emission wavelength of a semiconductor laser, has been a matter of interest in the art.

OPC is the material which comprises a bonding or dispersing agent consisting of an organic resin (binder), and a charge generating material (CGM) having photoconductive property dispersed in the binder. An electrophotographic photoreceptor is prepared, for example by applying OPC layer on an photoconductive substrate.

This type of electrophotographic photoreceptor which is equipped with the CGL made by OPC is generally referred to as an organic photoreceptor. As CGM, a functional pigment having photoconductive property such as a stable or a semistable phthalocyanine compound is generally employed.

A phthalocyanine compound has high spectral sensitivity through long wavelength region, high charge generating efficiency, high sensitivity, and high durability. Thus, a metal or a metal free phthalocyanine compound, such as x-form metal free phthalocyanine, titanyl phthalocyanine, and vanadyl phthalocyanine, has been employed in an organic photoreceptor.

An electrophotographic photoreceptor may be further equipped with CTL on a surface of CGL so that the charge occurred in CGL arrives efficiently at a surface of the photoreceptor, or so that the photoreceptor has sufficient strength. CTL is generally composed of a binder consisting of an organic resin, and a charge transporting material (CTM) dispersed in, or dissolved in the binder.

As CTM, a polyvinyl carbazole resin, an azole, a pyrazoline, a hydrazone, an enamine, a styryl, a stilbene, a triphenylmethane, a triphenylamine, a dibenzylaniline, and an azine compounds are known in the art.

In recent years, a semiconductor laser ray is employed as a light source of a copying machine or a laser printer, and as an electrophotographic photoreceptor for such a light source, a layered-form electrophotographic photoreceptor is employed. The wording "layered-form electrophotographic photoreceptor" means the electrophotographic photoreceptor which has a bi-layered photoreceptor layer, that is a photoreceptor layer composed of CGL and CTL. More currently, use of the layered-form electrophotographic photoreceptor covers over a printer having a short wavelength LD ray or light emitting diode as a light source.

In the art of electrophotographic photoreceptor, the monolayered-form electrophotographic photoreceptor which has a photoreceptor layer having a combination of amorphous selenium and polyvinylcarbazole is well known. Japanese Patent Kokai Publication 163047/1985 for example discloses an improved organic photoreceptor of this type, which contains CGM, CTM, and sensitizing dyes in a photoreceptor layer.

As a layered-form photoreceptor, Japanese Patent Kokoku Publication No. 41021/1990 discloses those having a photoreceptor layer composed of a selenium layer, and a polycarbonate layer containing a hydrazone CTM laid on the selenium layer; Japanese Patent Kokai Publications No. 196767/1985, and 262162/1985 disclose those having a photoreceptor layer composed of CGL containing a disazo CGM and a hydrazone CTM, and CTL comprising a polycarbonate resin and a hydrazone CTM laid on the CGL; Japanese Patent Kokai Publications No. 48551/1988, 48552/1988, and 4260/1992 disclose those having a photoreceptor layer composed of CGL containing a phthalocyanine pigment, and CTL containing a specific (bis)hydrazone CTM laid on the CGL; and Japanese Patent Kokai Publication No. 233548/1992 discloses those having a photoreceptor layer comprising a benzothiazole CTM.

However, the abovedescribed organic receptors are insufficient in electric properties (electrophotographic properties) such as chargeability, dark decay ratio, and residual potential, and in durability when they are charged and exposed many times. Partially azoic compound is now known as CGM responsible to a short wavelength light source such as LED and 633 LD, but it is poor in light resistance and durability by comparison with a phthalocyanine compound. Therefore there is a need for a photoreceptor having sufficient durability even if they are charged and exposed many times, and having sufficient sensitivity to a short wavelength light source.

The inventors disclosed in Japanese Patent Application No. 25206/1996 that $\mu$-oxo-aluminum phthalocyanine dimer having a novel polymorph was suitable as CGM for an organic photoreceptor having middle to high sensitivity. Some layered-form electrophotographic photoreceptors by using the $\mu$-oxo-aluminum phthalocyanine dimer as CGM in combination with some commercially available CTMs such as a hydrazone derivative and a butadiene derivative, are prepared and evaluated in the application. As a result, it was discovered that II-form polymorph of the $\mu$-oxo-aluminum phthalocyanine dimer was particularly excellent in electrophotographic properties as CGM. The inventors further discovered that the II-form polymorph had specific spectral sensitivity in the short wavelength region of 600 to 650 nm.

The inventors further tried based on such a background, many combinations of the II-form polymorph and various CTM, and found that the photoreceptor layer composed of CGL containing the II-form polymorph as CGM, and CTL containing a specific hydrazone CTM having a benzothiazolidene moiety laid on the CGL, shows remarkable electrophotographic properties.

SUMMARY OF THE INVENTION

The present invention provides a layered-form electrophotographic photoreceptor which is composed of a conductive substrate, a charge generating layer (CGL) laid on the conductive substrate, and a charge transporting layer (CTL) laid on the CGL, wherein the CGL includes $\mu$-oxo-aluminum phthalocyanine dimer as a charge generating material (CGM), and the CTL comprises as a charge transporting material (CTM) the compound represented by the formula:

(1)

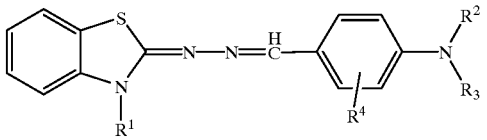

wherein $R^1$ represents an alkyl group or a phenyl group, $R^2$ and $R^3$ each independently represent a hydrogen atom, a substituted or an unsubstituted alkyl group, a substituted or an unsubstituted aryl group, or $R^2$ and $R^3$ may together form a heterocyclic ring, and $R^4$ represents an alkyl group or an alkoxy group.

Hereinafter, "phthalocyanine" is referred to as "Pc"; "$\mu$-oxo-aluminum phthalocyanine dimer" is referred to as "Al Pc dimer".

The layered-form electrophotographic photoreceptor shows good stability and good electric properties (for example, good chargeability, low dark decay ratio, and low residual potential), even if it is employed as a high-gamma photoreceptor which corresponds to a short wavelength light sauce such as LD ray and LED ray.

DETAILED DESCRIPTION OF THE INVENTION

Charge Generating Material (CGM)

Figure 1:
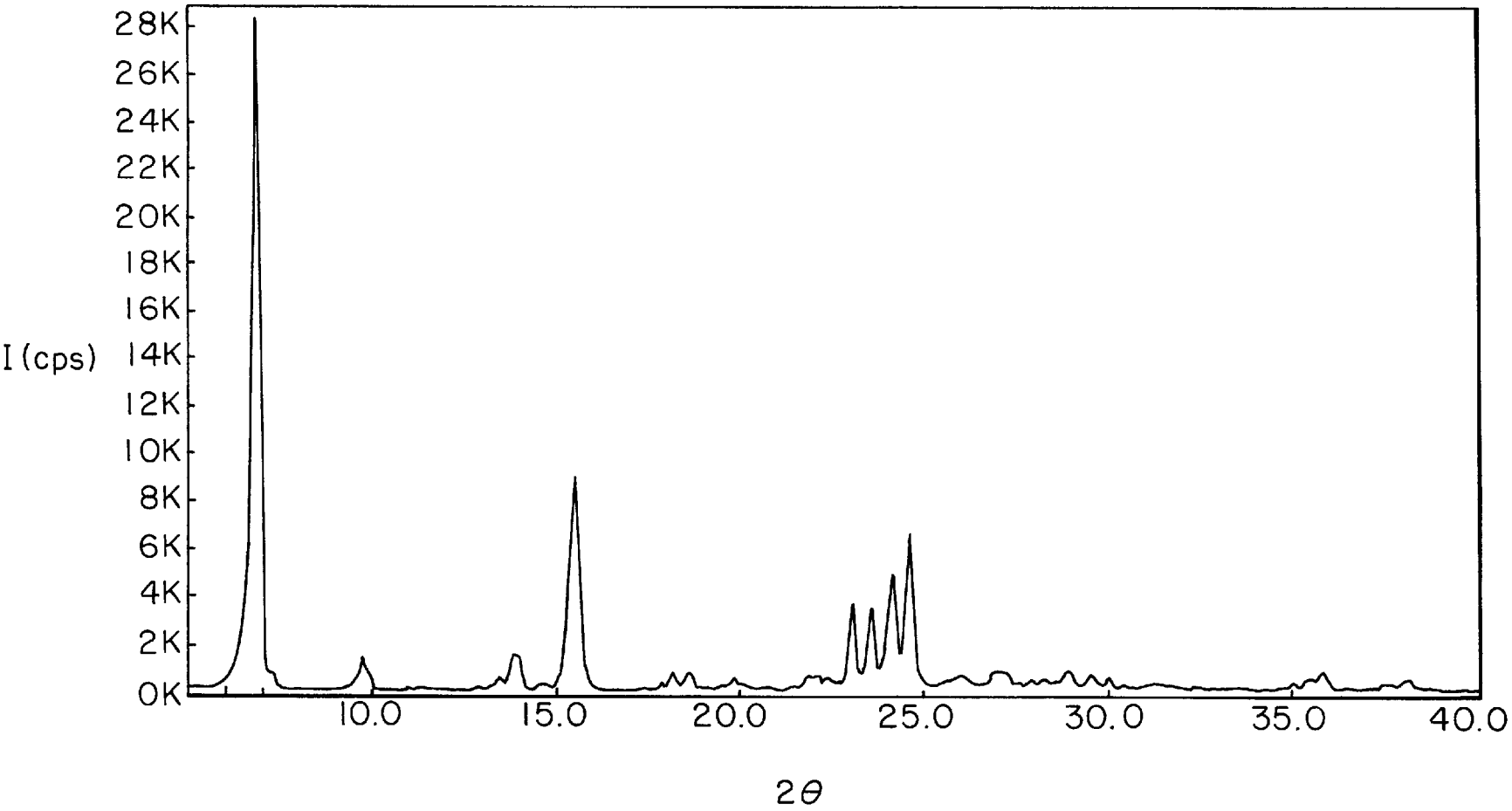
FIG. 1 is a X-ray diffraction spectrum of I-form polymorph, which is prepared in Preparation Example 1.

CGM employed in an layered-form electrophotographic photoreceptor of the present invention is Al Pc dimer having a specific polymorph. Preferably the polymorph of the Al Pc dimer is that the diffraction peaks at a Bragg angle (2 θ±0.2°) of 6.9°, 9.7°, 13.8°, 15.4°, 23.9°, and 25.9° in a X-ray diffraction spectrum by CuK α-ray is obtained (II-form polymorph). However Al Pc dimer having the other polymorph such as I-form, III-form, and IV-from may be employed.

Al Pc dimer is the compound known to the art. It is also known to the art that a certain polymorph of Al Pc dimer is employed as CGM.

Al Pc dimer may be prepared, for example by the following procedure. Phthalonitrile or 1,3-diiminoisoindoline is reacted in the presence of aluminum chloride in a high boiling point organic solvent such as 1-chloronaphthalene and quinoline to obtain chloroaluminum phthalocyanine.

The resulting chloroaluminum Pc is hydrolyzed to obtain hydroxyaluminum Pc. The process for obtaining hydroxyaluminum Pc from chloroaluminum Pc is, for example described in Japanese Patent Kokai Publications No. 93150/1993, and 214415/1994.

That is, the chloroaluminum Pc is hydrolyzed in an acidic or a basic solution, or subjected to acid pasting to prepare hydroxyaluminum Pc.

The resulting hydroxyaluminum Pc is refluxed with stirring in a water immiscible organic solvent such as o-dichlorobenzene, generated water is then excluded from the reaction system, and the product (Al Pc dimer) is collected by filtration. The product is then washed with DMF and then methanol etc., dried, and ground to obtain Al Pc dimer illustrated graphically as follows:

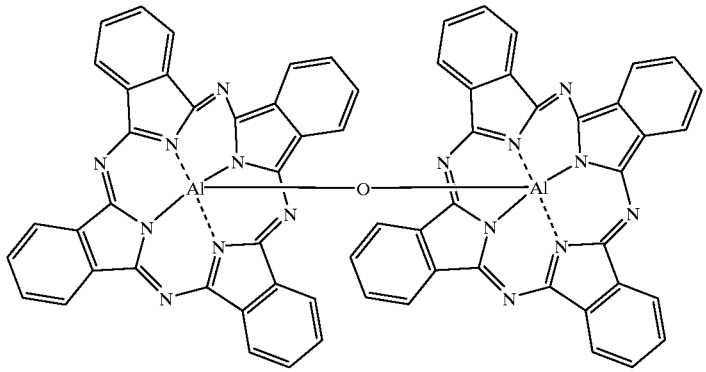

The resulting Al Pc dimer has the polymorph which shows diffraction peaks at a Bragg angle (2 θ±0.2°) of 6.9°, 15.6°, 23.0°, 23.5°, 24.2°, and 24.6°. The polymorph is referred to as "I-form" hereinafter.

The I-form Al Pc dimer is then dry milled. The wording "dry mill" or "dry milling" of the present specification means the step in which the substance is milled by using no solvent, but optionally using a mill medium, on a dispersing machine such as a ball mill, a sand mill, a paint shaker, an attritor, and an automatic mortar. Examples of the mill medium include glass beads, steel beads, zirconia beads, and alumina beads.

The Al Pc dimer resulted by the dry milling has the polymorph which shows diffraction peaks at a Bragg angle (2 θ±0.2°) of 6.8°, 15.4°, and 24.0° in a X-ray diffraction spectrum by CuK α-ray. The polymorph is referred to as "amorphous polymorph" in the specification.

The amorphous polymorph may further be wet milled or simply dispersed in a solvent to obtain the novel polymorph other than I-form. The wording "wet mill" or "wet milling" of the present specification means the step in which the substance is milled in the presence of a solvent. Wet milling is conducted in substantially the same manner as the dry milling, except using a solvent. Thus, a mill medium such as glass beads, steel beads, zirconia beads, and alumina beads may be employed in the wet milling. The wording "simply disperse" or "simply dispersing" means the step in which the substance is dispersed with stirring into a solvent. The simply dispersing may optionally be conducted with heating.

The wet milling or simply dispersing is conducted generally at room temperature for 20 to 100 hours, preferably 24 to 48 hours. If the step is conducted less than 10 hours, formation of the polymorph becomes insufficient, and even if the wet milling is conducted more than 100 hours, useful effect may not be obtained.

The solvent employed is not particularly limited, unless it solves a pigment. The solvent is generally selected, depending on a kind of the desired polymorph, from a ketone solvent, an alcohol solvent, a glycol solvent, a formamide solvent, an ether solvent, and an aromatic solvent.

Examples of the ketone solvent include linear or cyclic ketones such as cyclohexanone, diisopropyl ketone, methyl ethyl ketone (MEK), methyl isobutyl ketone (MIBK). Examples of the alcohol solvent include monohydric lower alcohols such as methanol, ethanol, propanol, isopropanol, amyl alcohol, and hexanol. Examples of the glycol solvent include alkylene glycols such as ethylene glycol, diethylene glycol, and trimethylene glycol; alkylene glycol monoalkyl ethers such as ethylene glycol monomethyl ether, ethylene glycol monoethyl ether, propylene glycol monomethyl ether; ethylene glycol dialkyl ethers such as monoglyme, diglyme, triglyme, and tetraglyme. Examples of the formamide solvent include dimethylformamide (DMF), and dimethylacetamide. Examples of the ether solvent include linear or cyclic ethers such as tetrahydrofuran (THF), dioxane, ethyl ether, and butyl ether. Examples of the aromatic solvent include hydrocarbon solvents such as toluene, o-xylene, and tetralin.

When the amorphous polymorph is wet milled or simply dispersed in the ketone solvent such as cyclohexanone and diisopropyl ketone, preferably cyclohexanone; the alcohol solvent such as amyl alcohol, and ethanol; the glycol solvent such as diethylene glycol, and trimethylene glycol; the formamide solvent such as DMF; and the ether solvent such as THF; the II-form Al Pc dimer is obtained. Among the solvents, cyclohexanone is particularly preferred.

When the amorphous polymorph is wet milled or simply dispersed in the glycol solvent such as ethylene glycol, Al Pc dimer having the polymorph which shows diffraction peaks at a Bragg angle (2 θ±0.2°) of 6.9°, 14.0°, 15.7°, and 25.7° in a X-ray diffraction spectrum is obtained. The polymorph is referred to as "III-form".

When the amorphous polymorph is wet milled or simply dispersed in polyethylene glycol dialkyl ethers such as monoglyme, diglyme, triglyme, tetraglyme, and the like, Al Pc dimer having the polymorph which shows diffraction peaks at a Bragg angle (2 θ±0.2°) of 6.9°, 13.0°, 14.8°, 16.1°, 21.1°, 25.1° and 25.8° in a X-ray diffraction spectrum, is obtained. The polymorph is referred to as "IV-form".

The Al PC dimer employed in the present invention, or the polymorph thereof (I-form, amorphous form, II-form, III-form, or IV-form) may be identified by the FD-MS (Field Desorption MS) method, the TOF-MS (Time of Flight MS) method, the IR analysis, and the like.

Charge Transporting Material (CTM)

CTM employed in an layered-form electrophotographic photoreceptor of the present invention is preferably a specific hydrazone compound represented by formula (1), which has a benzothiazolidene moiety. The compound of formula (1) is known to the art, and the use of the compound of formula (1) as CTM is also known to the art.

The compound of formula (1) may be prepared according to the process known to the art. That is, heterocyclic hydrazone and corresponding aldehyde or ketone are dissolved in a solvent, a small amount of acid (acetic acid or inorganic acid) is optionally added thereto, and dehydrocondensation reaction is conducted to obtain the compound of formula (1).

As the solvent, alcohols such as methanol, and ethanol; aromatic hydrocarbons such as benzene, and xylene; dioxane; tetrahydrofuran; and N,N-dimethylformamide are employed in alone or in combination.

In formula (1), $R^1$ preferably represents a linear or a branched alkyl group having 1 to 8 carbon atoms such as a methyl group, an ethyl group, a propyl group, a butyl group, a pentyl group, a hexyl group, and an octyl group; an alkyl group substituted with an alkoxy group such as a methoxy group and an ethoxy group (an alkoxyalkyl group); a phenyl group; a phenyl group substituted with an alkyl group such as a methyl group and an ethyl group (an alkylphenyl group); a phenyl group substituted with an alkoxy group such as a methoxy group and an ethoxy group (an alkoxyphenyl group).

$R^2$ and $R^3$ preferably represent independently a linear or a branched alkyl group having 1 to 12 carbon atoms such as a methyl group, an ethyl group, a propyl group, a butyl group, a pentyl group, a hexyl group, and an octyl group; an alkoxyalkyl group having 2 to 12 carbon atoms, for example an alkyl group substituted with a methoxy group, an ethoxy group, or a propoxy group; a phenyl group; a phenyl group substituted with an alkyl group such as a methyl group and an ethyl group (an alkylphenyl group); a phenyl group substituted with an alkoxy group such as a methoxy group and an ethoxy group (an alkoxyphenyl group). $R^2$ and $R^3$ may together form a heterocyclic ring having 5 to 10 carbon atoms, such as the groups represented by the formulae:

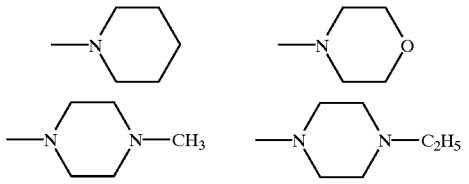

-continued

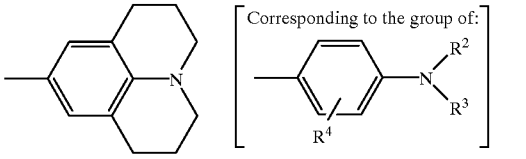

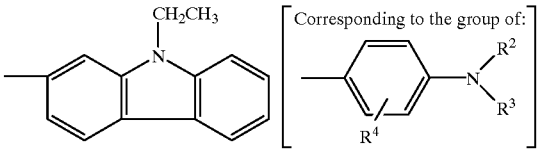

$R^4$ preferably represents an alkyl group having 1 to 4 carbon atoms such as a methyl group, and an ethyl group; an alkoxy group having 1 to 4 carbon atoms such as a methoxy group, and an ethoxy group; and a haloalkyl group having 1 to 4 carbon atoms such as a $CF_3$ group.

Specific examples of the preferred CTM are as follows:

(1-a)

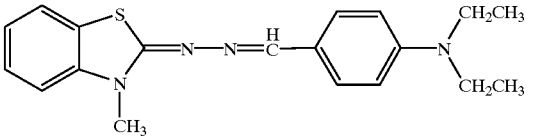

(1-b)

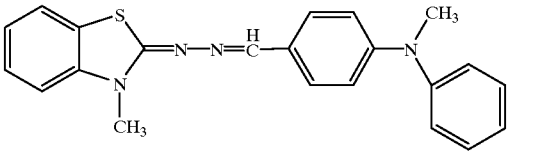

(1-c)

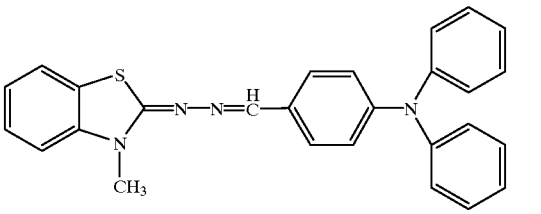

(1-d)

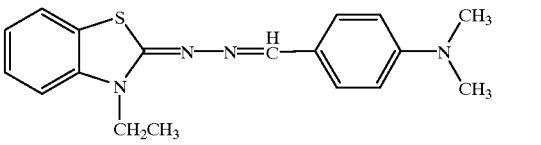

(1-e)

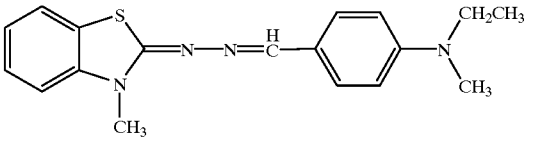

-continued (1-f)

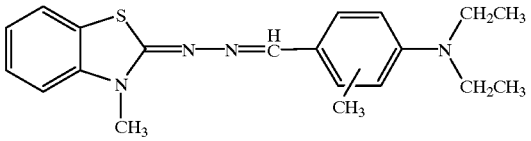

(1-g)

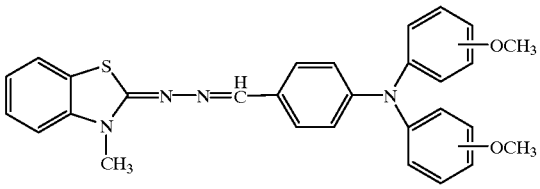

(1-h)

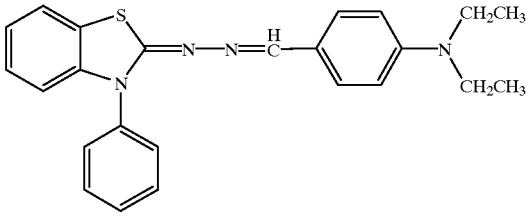

(1-i)

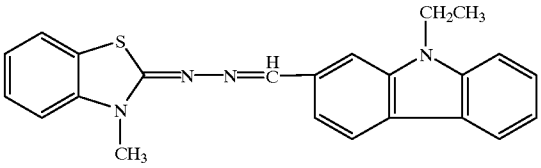

Layered-form Electrophotographic Photoreceptor

The electrophotographic photoreceptor generally has a conductive substrate, and a photoreceptor layer formed thereon which comprises CGM and CTM. The photoreceptor layer may be classified depending on its structure, as a mono-layered one and a bi-layered one. The bi-layered photoreceptor layer is composed of CGL and CTL. CGL and CTL in the bi-layered photoreceptor layer do not inhibit the respective functions, and they efficiently transfer the generated charge to a surface of the electrophotographic photoreceptor without trapping the charge. Thus, it is preferred that the bi-layered photoreceptor layer is employed in the present invention.

The electrophotographic photoreceptor which has the bi-layered photoreceptor layer is referred to as a layered-form electrophotographic photoreceptor. The layered-form electrophotographic photoreceptor is also referred to as a function separated-form photoreceptor.

The function separated-form photoreceptor is for example prepared by the process in which CGL is laid on a conductive substrate, and CTL is laid thereon. Examples of the conductive substrate include metal (e.g., aluminum, and nickel), metal vapor-deposited film, and the like, in the form of a drum, a sheet or a belt.

The layered-form electrophotographic photoreceptor of the present invention is composed of a conductive substrate, CGL and CTL laid on the conductive substrate. The CGL includes Al Pc dimer as CGM dispersed in a resin. The CTL includes the compound represented by formula (1) as CTM dispersed or dissolved in a resin. Particularly preferred embodiment employs II-form Al Pc dimer (II-form polymorph) as CGM.

CGL is formed as a thin layer on the conductive substrate. It can be formed by vapor-depositing the Al Pc dimer, but is generally formed by applying a binder resin dispersion of the Al Pc dimer. The binder resin dispersion may be prepared by dispersing the Al Pc dimer into a solution of a suitable binder resin, using a usual dispersing apparatus such as ball mill, sand mill, paint shaker, and the like.

A process for coating the binder resin dispersion is not specifically limited, and suitably include bar coating, dip coating, spin coating, roller coating, calendar coating, and the like. The coated layer may be dried at a temperature of 30 to 200° C. for 5 minutes to 2 hours in the presence or absence of blast.

A solvent optionally be employed for preparing the dispersion. The solvent is not particularly limited, unless it solves CGM. However, the solvent have to disperse CGM uniformly and to solve the binder resin. Examples thereof include alcohol solvents such as methanol, ethanol, isopropanol and butanol; aromatic solvents such as toluene, xylene and tetralin; halogenated solvents such as dichloromethane, chloroform, trichloroethylene and carbon tetrachloride; ester solvents such as ethyl acetate and propyl acetate; ether solvents such as ethylene glycol monoethyl ether, dioxane and tetrahydrofuran; dimethylformamide and dimethyl sulfoxide.

The binder resin can be selected from a wide range of insulating resins. Examples of the preferred resin include condensation resins such as polycarbonate, polyacrylate, polyester and polyamide; addition polymers such as polystyrene, styrene-acrylic copolymer, polyacrylate, polymethacrylate, polyvinyl butyral, polyvinyl alcohol, polyacrylonitrile, polyacrylic-butadiene copolymer, polyvinyl chloride and vinyl chloride-vinyl acetate copolymer; organic photoconductive resins such as poly-N-vinyl carbazole and polyvinylanthracene; polysulfone, polyether sulfone, silicone resin, epoxy resin and urethane resin. These are used in alone or in combination thereof.

The binder resin is employed in an amount of from 0.1 to 3 ratio by weight, preferably 0.5 to 2.0 by weight based on CGM. When the amount is more than 3, the charge generation decreases, and sensitivity of the photoreceptor layer becomes poor. CGL is preferably formed in a thickness of from 0.05 to 5.0 μm, preferably 0.1 to 3.0 μm. When the thickness is more than 5.0 μm, charge may readily be trapped, and sensitivity of the photoreceptor layer becomes poor.

CTL containing the benzothiazolidene CTM of formula (1) is then formed on CGL. CTL may be formed in the same manner as described above for forming CGL. That is, CTM is dissolved in a solvent with a binder resin, and the resulting solution is uniformly applied on CGL, followed by drying.

The binder resin and the solvent which are employed for CGL may be employed.

The binder resin is employed in an amount of from 0.1 to 5 ratio by weight, preferably 0.5 to 2.0 ratio by weight based on CTM. When the amount is more than 5, concentration of CTM in CTL becomes small, and sensitivity of the photoreceptor layer becomes poor. CTL is preferably formed in a thickness of from 5 to 50 μm, preferably 10 to 40 μm. When the thickness is more than 50 μm, long time is required for transporting charge, and the charge may readily be trapped, and thereby sensitivity of the photoreceptor layer becomes poor.

The following Examples and Comparative Examples further illustrate the present invention in detail but are not to be construed to limit the scope thereof.

EXAMPLES

The preparation method of Al Pc dimer employed in the present invention is disclosed in Japanese Patent Kokai Publication 217020/1997, or Journal of Chemical Society of Japan, Chemistry and Industrial Chemistry, 1997, No. 12, pages 887 to 898, in detail.

The X-ray diffraction spectrum by CuK α-ray was measured by using the automatic X-ray diffraction system "MXP3"™ available from Max Science Co. Ltd., and TOF-MS (Time of Flight Mass Spectroscopy) was measured by using "COMPACT MALDI III"™ available from Kratos-Shimazu Co. Ltd., in the detection mode "Positive", the voltage "Low (5 kV)", and the flying mode "Reflection", in the Examples.

Preparation Example 1

Synthesis of I-form Al Pc dimer (I-form polymorph)

Phthalonitrile (60.0 g, 0.469 mol, 98% purity), 300 ml of 1-chloronaphthalene, and 15.6 g (0.117 mol, 98% purity) of aluminum chloride were charged in a 500 ml glass four-necked flask equipped with requisite apparatuses such as a stirrer, a calcium chloride tube, and the like, and the mixture was refluxed with stirring for 6 hours. Heating was then stopped and the mixture was cooled to about 150° C., and hot filtered and washed with hot toluene, toluene, and acetone.

The resulting wet cake was dispersed in toluene, and refluxed with stirring for 3 hours. The mixture was hot filtered, and washed again with hot toluene, toluene, and acetone. The product was then dispersed in ion exchanged water, and heated to 60 to 70° C. with stirring for 60 min. The mixture was filtered, and vacuum dried at 60 to 70° C. to obtain 60.0 g of blue solid chloroaluminum Pc (90.0% yield).

The chloroaluminum Pc (55.1 g) was slowly added to 1.1 L (litter) of conc. sulfonic acid, with controlling a temperature thereof not more than 5° C., and the mixture was stirred for 1 hour. The mixture was then poured into 20 L of ice water with stirring and controlling at a temperature thereof not more than 5° C., and stirred for 2 hours at room temperature. The solid deposited from the mixture was filtered and washed with water. The resulting wet cake was stirred with heating and refluxing in 4% aqueous ammonia for 6 hours, and filtered again. The cake was thoroughly washed with ion-exchanged water, dried under vacuum at 50° C. for 2 days, and ground to obtain 49.1 g of blue solid hydroxyaluminum Pc.

The hydroxyaluminum Pc (47.0 g) was added to 470 ml of o-dichlorobenzene, and was stirred at a temperature between 150 to 180° C. for 1 hour. The vaporized water was removed through Liebig condenser. The solid was hot filtered and washed with o-dichlorobenzene, and then replaced with methanol. The product was dried, and ground to obtain 39.3 g (35.9 mmol) of Al Pc dimer. The Al Pc dimer was identified by conducting the FD-MS analysis and the TOF-MS analysis.

This is I-form dimer having the polymorph which shows diffraction peaks in the X-ray diffraction spectrum as shown in FIG. 1. The diffraction peaks of the product was a Bragg angle (2 θ±0.2°) of 6.9°, 15.6°, 23.0°, 23.5°, 24.2°, and 24.6°.

Preparation Example 2

Synthesis of II-form Al Pc dimer (II-form polymorph)

I-form Al Pc dimer prepared in Preparation Example 1 (7.0 g), and 80 g of glass beads having a diameter of 5 mm ϕ were charged in a wide-mouthed bottle, and the mixture was dry milled for 1 to 2 days using a dispersing apparatus (paint shaker). The polymorph of the mixture was followed by sampling a part of the mixture. When the polymorph became fixed, the glass beads were filtered out, and 6.64 g of blue solid Al Pc dimer (amorphous polymorph) was obtained.

Cyclohexane (30 ml) was added to 1.0 g of the Al Pc dimer (amorphous polymorph), and the mixture was refluxed with stirring (simply dispersed) for 12 hours. The mixture was allowed to cool, and filtered. The wet cake was washed with methanol and dried under vacuum to obtain 0.5 g of blue solid Al Pc dimer.

Figure 2:
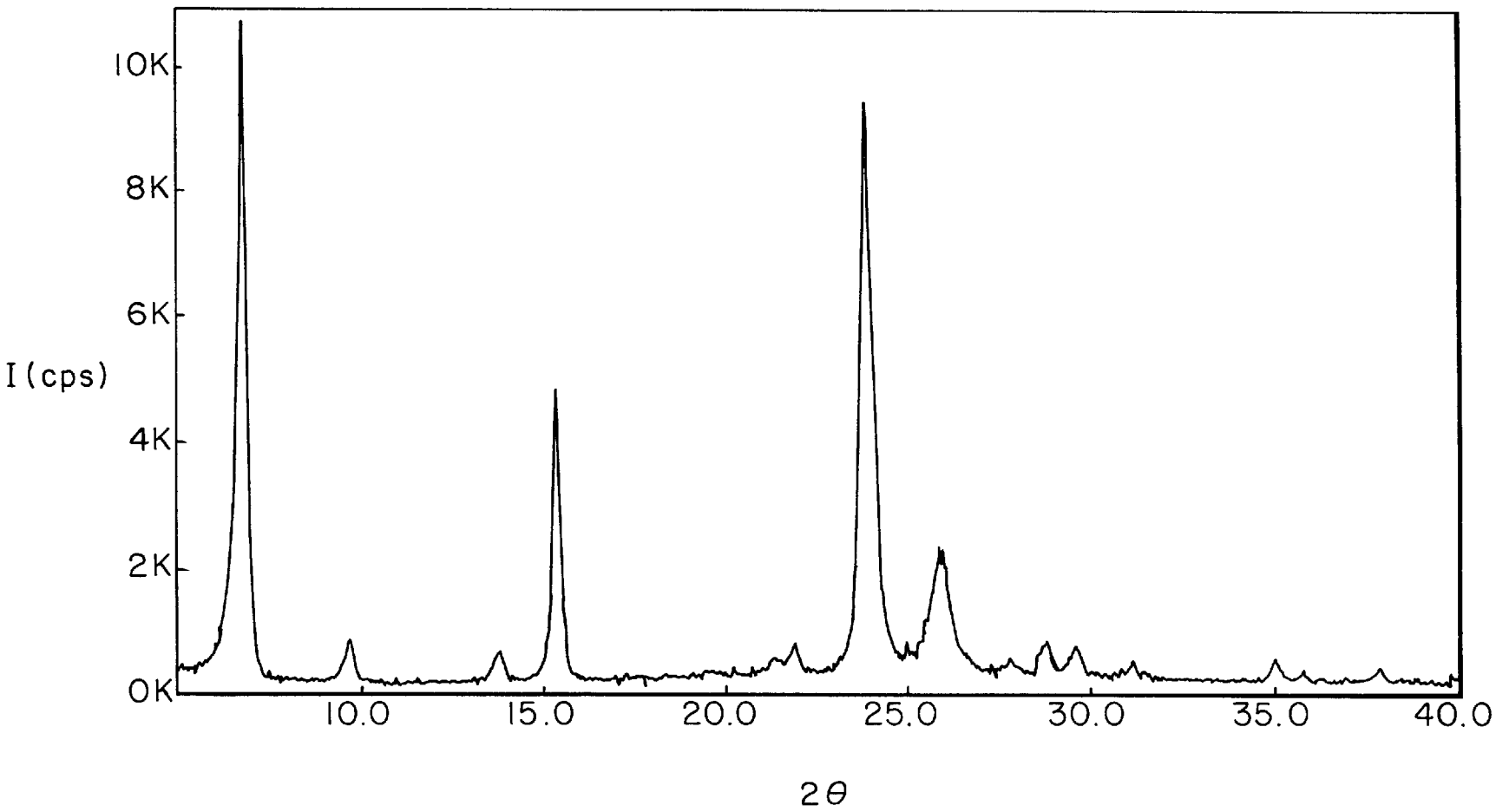
FIG. 2 is a X-ray diffraction spectrum of II-form polymorph, which is prepared in Preparation Example 2.

A X-ray diffraction spectrum of the product was shown in FIG. 2. The result of TOF-MS was substantially the same as that of Preparation Example 1.

The above described results show that the product is Al Pc dimer, and the X-ray diffraction spectrum shows that the Al Pc dimer is II-form dimer which shows diffraction peaks at a Bragg angle (2 θ±0.2°) of 6.9°, 9.7°, 13.8°, 15.4°, 23.9°, and 25.9°.

Reference Examples

Synthesis of II-form Al Pc dimer

II-form Al Pc dimer of the present invention was prepared according to substantially the same manner as described in Preparation Example 2, except that the solvent and conditions tabulated in table 1 was used.

A X-ray diffraction spectrum, an infrared absorption spectrum, and the result of TOF-MS were substantially the same as those of Example 2.

TABLE 1

| CGM | | Condition | | | Poly- |
|---|---|---|---|---|---|
| No. | Solvent | Temp (° C.) | Time | Procedure | morph[1] |
| II-2 | DMF | reflux | 12 | simply disp. | II |
| II-3 | Amyl alcohol | reflux | 12 | simply disp. | II |
| II-4 | THF | reflux | 12 | simply disp. | II |
| II-5 | Trimethylene glycol | 150 | 5 | simply disp. | II |
| II-6 | o-Xylene | reflux | 26 | simply disp. | II |
| II-7 | Diethylene glycol | 100 | 7 | simply disp. | II |
| II-8 | Ethanol | room temp. | 72 | wet milling | II |
| II-9 | Diisopropyl ketone | reflux | 12 | simply disp. | II |

[1]Polymorph of the resulting Al Pc dimer.

The following Examples illustrate the layered-form electrophotographic photoreceptor of the present invention.

Example 1

The II-form Al Pc dimer prepared in Preparation Example 2 was used as CGM. II-form Al Pc dimer (0.2 g), 0.2 g of a polyvinyl butyral resin ("ELEX BH-3"™ available from Sekisui Kagaku K. K.), 59.6 g of cyclohexanone, and 50 g of glass beads having a diameter of 3 mmϕ were charged in a wide-mouthed bottle. The mixture was shook for 1 hour using a dispersing apparatus (paint shaker), and applied on an aluminum plate by a bar coater. The coating was dried in air to form a CGL having a thickness of 0.5 μm.

Then, N-[p-(diethylamino)benzylidene]-N'-(3-methyl-2-benzothiazolidene)hydrazine ("CT-504"™ available from Fuji Photo Film Co. Ltd.) represented by the following formula, 4.5 g of a polycarbonate resin ("PANLIGHT L-1250"™ available from Teijin K. K.), and 51.0 g of methylene chloride were charged in a wide-mouthed bottle. The mixture was homogenized by using supersonic wave, and applied on the CGL by a bar coater. The coated layer was dried in air to form CTL having a thickness of 60 μm. Thereby, a layered-form electrophotographic photoreceptor was prepared.

(1-a)

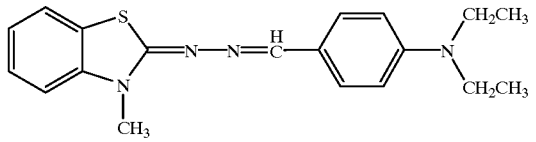

Comparative Example 1

A layered-form electrophotographic photoreceptor was prepared according to substantially the same manner as described in Example 1, except that 1,1-bis(p-diethylaminophenyl)-4,4'-diphenyl-1,3-butadiene (Trade name "T-405"™ available from Takasago Koryo K. K.) was used as CTM instead of the benzothiazolidene compound represented by formula (1-a).

Comparative Example 2

A layered-form electrophotographic photoreceptor was prepared according to substantially the same manner as described in Example 1, except that 4-benzylamino-2-methylbenzaldehyde-1,1'-diphenylhydorazone ("CTC-191"™ available from Takasago Koryo K. K.) was used as CTM instead of the benzothiazolidene compound represented by formula (1-a).

Comparative Example 3

A layered-form electrophotographic photoreceptor was prepared according to substantially the same manner as described in Example 1, except that N-[p-(diphenylamino) benzaldehyde)]-N'-methyl-N'-phenylhydrazone ("CT-501"™ available from Fuji Photo Film Co. Ltd.) was used as CTM instead of the benzothiazolidene compound represented by formula (1-a).

Comparative Example 4

A layered-form electrophotographic photoreceptor was prepared according to substantially the same manner as described in Example 1, except that N-[p-(diphenylamino) benzaldehyde)]-N',N'-diphenylhydrazone ("CT-502"™ available from Fuji Photo Film Co. Ltd.) was used as CTM instead of the benzothiazolidene compound represented by formula (1-a).

Comparative Example 5

A layered-form electrophotographic photoreceptor was prepared according to substantially the same manner as described in Example 1, except that N-[p-(phenylmethylamino)benzaldehyde)]-N',N'-diphenylhydrazone ("CT-503"™ available from Fuji Photo Film Co. Ltd.) was used as CTM instead of the benzothiazolidene compound represented by formula (1-a).

Evaluation of the Photoreceptors

Electrophotographic properties of the layered-form electrophotographic photoreceptors prepared in Example 1 and Comparative Examples 1 to 5 were measured. A static electricity charging tester "EPA-8200" available from Kawaguchi Denki K. K. was used as the measuring apparatus.

The layered-form electrophotographic photoreceptors were corona charged at −8.0 kV in STAT 3 mode by first. They were then left in the dark for 2.0 seconds, and irradiated by 5.0 lux white light for 10.0 seconds. The initial charged potential ($V_0$), the sensitivity half-value irradiation amount ($E_{1/2}$), the residual potential (Vr), and the dark decay ratio (%) were recorded. The results were shown in Table 2.

TABLE 2

| Ex. No. | CTM | $V_0$ (V) | DDR* (%) | Vr (V) | $E_{1/2}$ (Lx · s) |
|---|---|---|---|---|---|
| 1 | CT-504 | −467.0 ◎ | 22.9 | −8.0 ◎ | 3.33 ◎ |
| C1 | T-405 | −224.7 X | 40.1 | −4.0 ◎ | 1.74 ◎ |
| C2 | CTC-191 | −356.3 ○ | 34.0 | −30.7 X | 3.28 ◎ |
| C3 | CT-501 | −412.0 ◎ | 26.1 | −24.0 Δ | 3.12 ◎ |
| C4 | CT-502 | −343.7 ○ | 32.5 | −19.7 ○ | 2.84 ◎ |
| C5 | CT-503 | −378.7 ○ | 29.7 | −43.3 X | 3.49 ◎ |

*DDR: Dark decay ratio
"◎" means excellent which is the level same as Example 1;
"○" means good;
"Δ" represents slight failure; and
"X" represents failure.

Spectral Sensitivity and Durability

Figure 3:
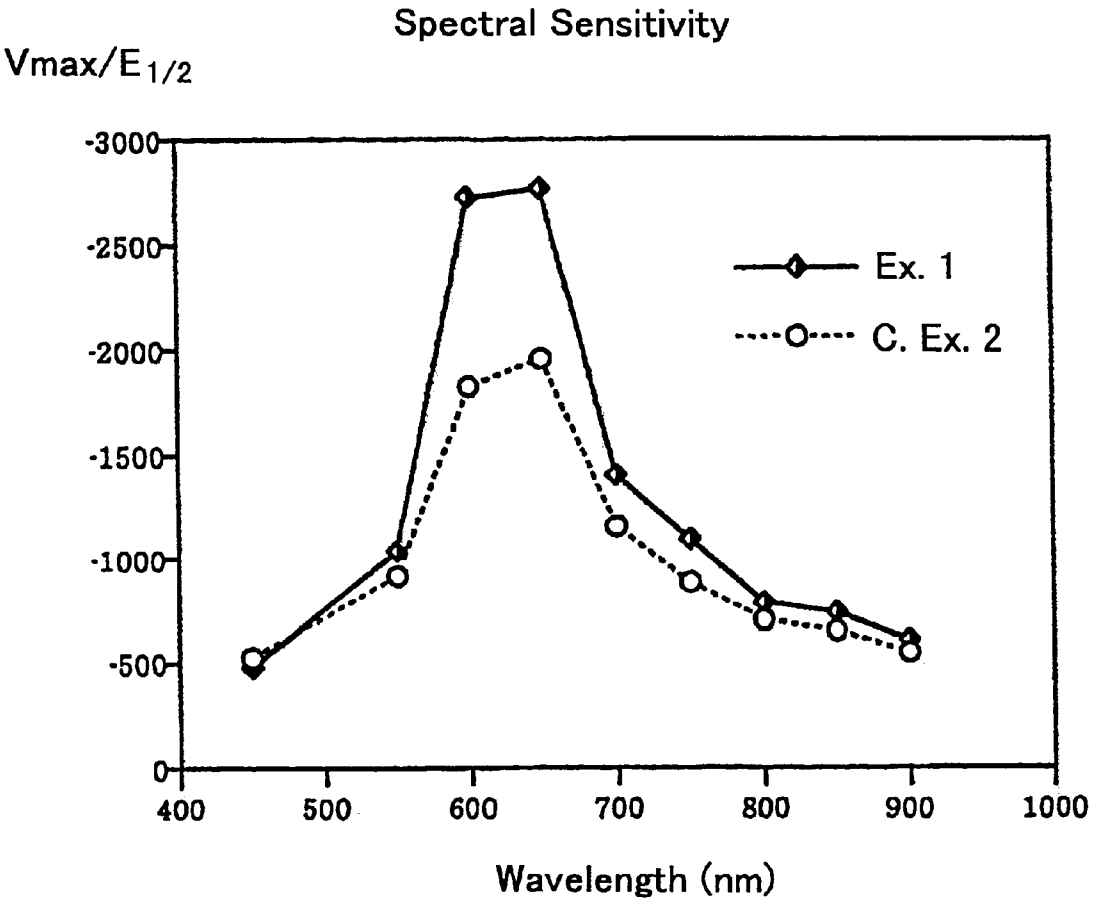
FIG. 3 is a graph showing spectral sensitivity of the layered-form electrophotographic photoreceptors obtained by Example 1 and Comparative Example 2.
Figure 4:
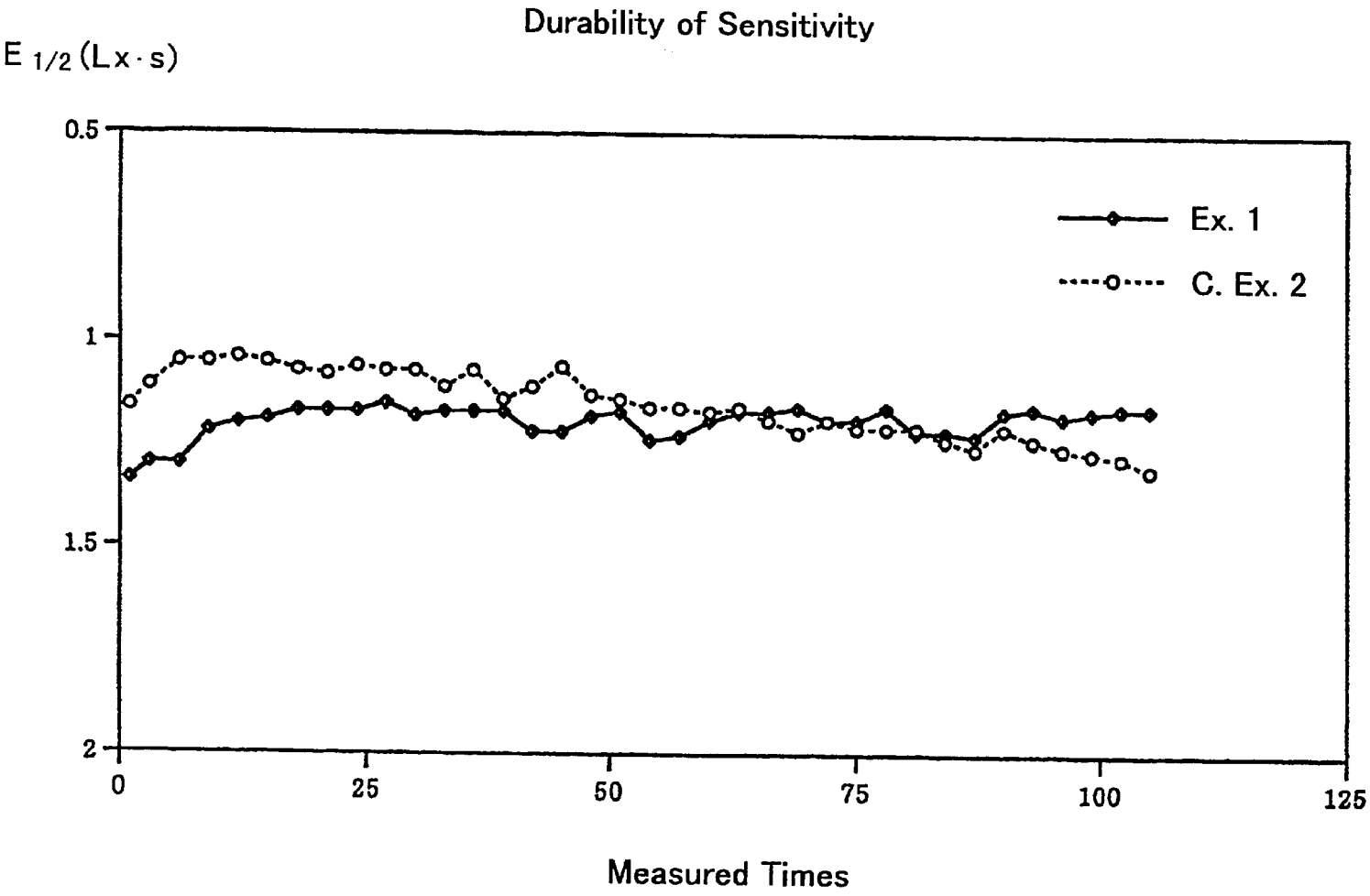
FIG. 4 is a graph showing durability of sensitivity of the layered-form electrophotographic photoreceptors obtained by Example 1 and Comparative Example 2.
Figure 5:
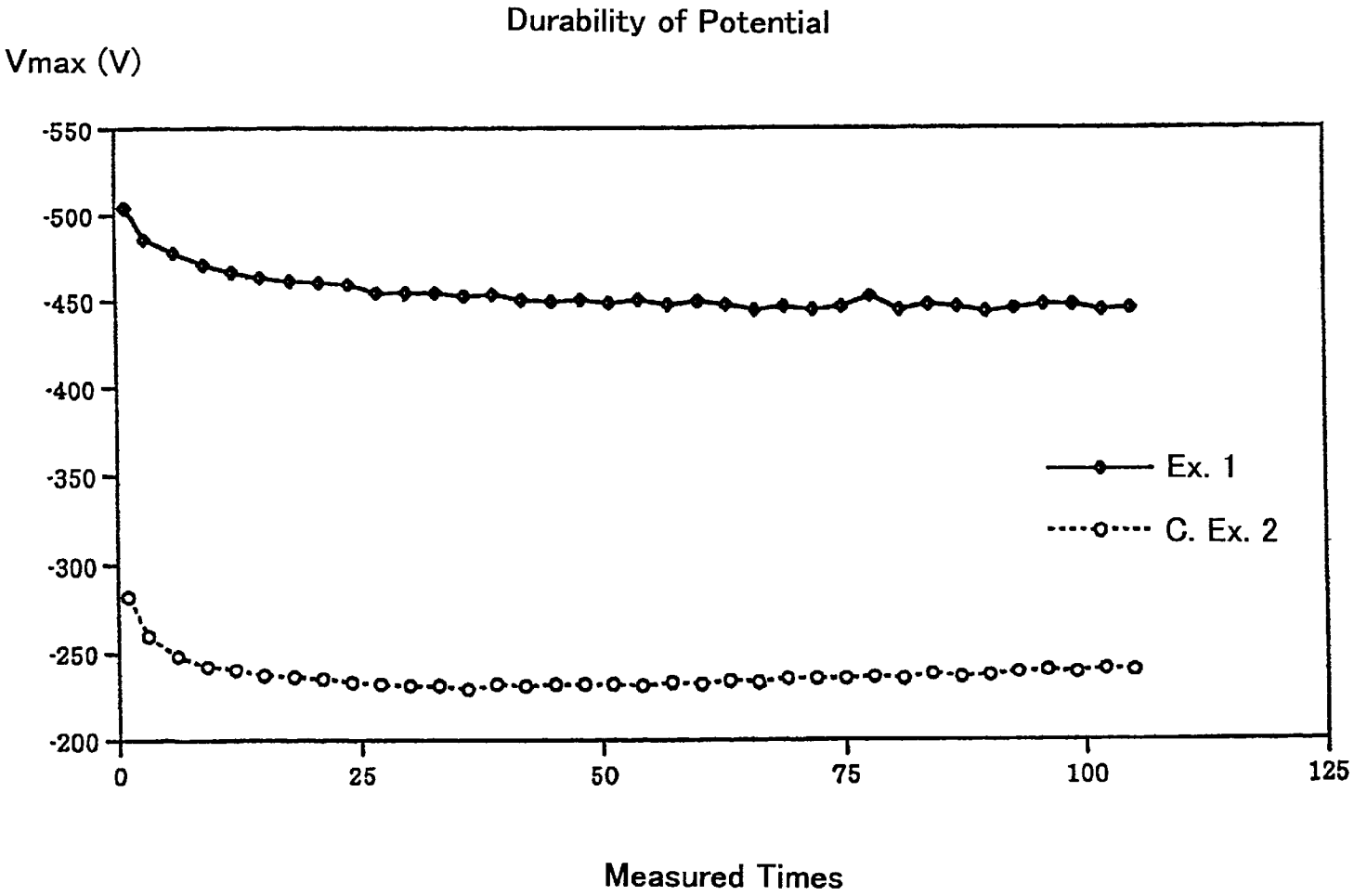
FIG. 5 is a graph showing durability of potential of the layered-form electrophotographic photoreceptors obtained by Example 1 and Comparative Example 2.

FIG. 3 is a graph showing spectral sensitivity of the layered-form electrophotographic photoreceptors obtained by Example 1 and Comparative Example 2. FIG. 4 is a graph showing durability of sensitivity of the layered-form electrophotographic photoreceptors obtained by Example 1 and Comparative Example 2. FIG. 5 is a graph showing durability of potential of the layered-form electrophotographic photoreceptors obtained by Example 1 and Comparative Example 2.

As shown in Table 2, Example 1 shows improved electrophotographic properties by comparison with Comparative Examples. As shown in FIG. 3, spectral sensitivity of Example 1 is remarkably improved by comparison with Comparative Example 2.

Although durability of sensitivity of Example 1 is the level similar to Comparative Example 2 (FIG. 4), durability of potential of Example 1 is remarkably improved by comparison with Comparative Example 2 (FIG. 5). As to sensitivity half-value irradiation amount ($E_{1/2}$) of Comparative Example 1, a good valuation is shown in Table 2. However, the good valuation does not show good electrophotographic properties of Comparative Example 1. That is, the good valuation is mainly because low initial charged potential, and high dark decay rate of Comparative Example 1, and electrophotographic properties Comparative Example 1 is practically poor.

What is claimed is:

1. A layered-form electrophotographic photoreceptor which is composed of a conductive substrate, a charge generating layer (CGL) laid on the conductive substrate, and a charge transporting layer (CTL) laid on the CGL, wherein the CGL includes $\mu$-oxo-aluminum phthalocyanine dimer as a charge generating material (CGM), and the CTL comprises as a charge transporting material (CTM) the compound represented by the formula:

(1)

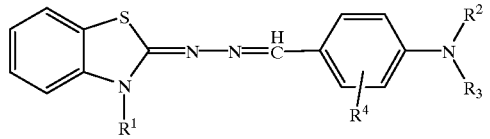

wherein $R^1$ represents an alkyl group or a phenyl group, $R^2$ and $R^3$ each independently represent a hydrogen atom, a substituted or an unsubstituted alkyl group, a substituted or an unsubstituted aryl group, or $R^2$ and $R^3$ may together form a heterocyclic ring, and $R^4$ represents an alkyl group or an alkoxy group.

2. The layered-form electrophotographic photoreceptor according to claim 1, wherein $R^1$ represents a substituted or an unsubstituted, a linear or a branched alkyl group having 1 to 8 carbon atoms, and $R^2$ and $R^3$ each independently represent a substituted or an unsubstituted, a linear or a branched alkyl group having 1 to 12 carbon atoms.

3. The layered-form electrophotographic photoreceptor according to claim 1, wherein the charge generating material is $\mu$-oxo-aluminum phthalocyanine dimer having a polymorph which shows one group of diffraction peaks at a Bragg angle (2 θ±0.2°) selected from the following groups (1) to (4) in a X-ray diffraction spectrum by CuK α-ray:

(1) 6.9°, 15.6°, 23.0°, 23.5°, 24.2°, and 24.6° (I-form);

(2) 6.9°, 9.7°, 13.8°, 15.4°, 23.9°, and 25.9° (II-form);

(3) 6.9°, 14.0°, 15.7°, and 25.7° (III-form); and (4) 6.9°, 13.0°, 14.8°, 16.1°, 21.1°, 25.1°, and 25.8° (IV-form).

4. The layered-form electrophotographic photoreceptor according to claim 1, wherein the charge generating material is $\mu$-oxo-aluminum phthalocyanine dimer having a polymorph which shows diffraction peaks at a Bragg angle (2 θ±0.2°) of 6.9°, 9.7°, 13.8°, 15.4°, 23.9°, and 25.9° in a X-ray diffraction spectrum by CuK α-ray (II-form).

5. A layered-form electrophotographic photoreceptor which is composed of a conductive substrate, a charge generating layer (CGL) laid on the conductive substrate, and a charge transporting layer (CTL) laid on the CGL, wherein the CGL includes $\mu$-oxo-aluminum phthalocyanine dimer as a charge generating material (CGM), and the CTL comprises as a charge transporting material (CTM) a compound selected from the group consisting of:

(1-a)

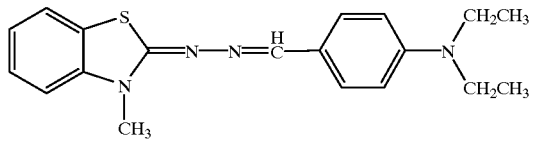

(1-b)

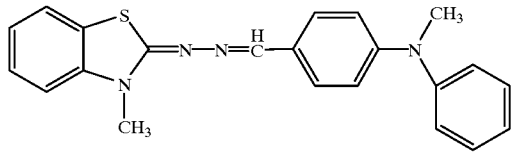

-continued (1-c)

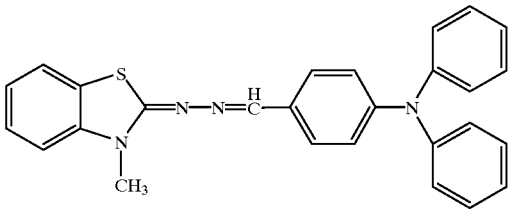

(1-d)

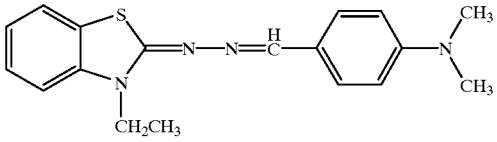

(1-e)

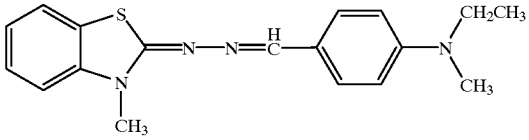

(1-f)

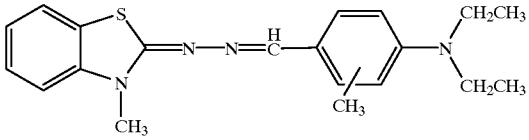

(1-g)

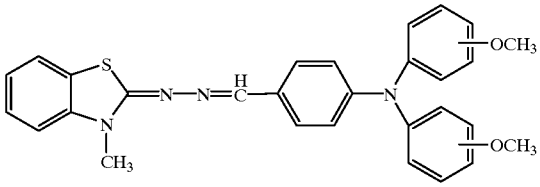

-continued (1-h)

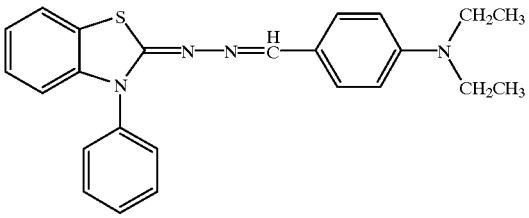

and (1-i)

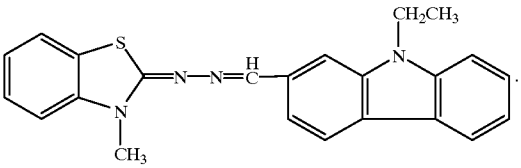

6. A layered-form electrophotographic photoreceptor which is composed of a conductive substrate, a charge generating layer (CGL) laid on the conductive substrate, and a charge transporting layer (CTL) laid on the CGL, wherein the CGL includes $\mu$-oxo-aluminum phthalocyanine dimer as a charge generating matieral (CGM), and the CTL comprises as a charge transporting material (CTM) a compound of the formula:

(1-a)

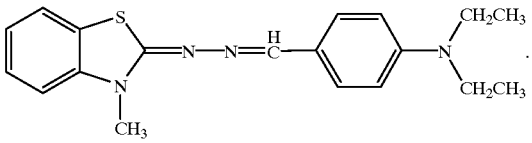

* * * * *